United States Patent [19]

Burkholder et al.

[11] 4,092,751

[45] June 6, 1978

[54] CONTOURED FOAM SEAT

[75] Inventors: Theodore B. Burkholder, Perrysburg; Robert J. Stalter, Bowling Green, both of Ohio

[73] Assignee: The Goodyear Tire & Rubber Company, Akron, Ohio

[21] Appl. No.: 683,975

[22] Filed: May 6, 1976

[51] Int. Cl.[2] ..... A47C 23/00

[52] U.S. Cl. ..... 5/345 R; 5/361 B; 267/142; 297/455; 297/459; 297/DIG. 1; 297/DIG. 2

[58] Field of Search ..... 5/361 R, 361 B, 345; 297/455–456, 458–460, DIG. 1, DIG. 2; 267/142

[56] References Cited

U.S. PATENT DOCUMENTS

| | | | |
|---|---|---|---|
| 2,785,739 | 3/1957 | McGregor et al. | 5/361 B X |
| 2,854,230 | 9/1958 | Jones et al. | 5/361 R X |
| 3,512,190 | 5/1970 | Buff | 5/361 B X |
| 3,614,159 | 10/1971 | Christen | 297/459 X |
| 3,679,263 | 7/1972 | Cadiou | 297/456 |

*Primary Examiner*—James C. Mitchell
*Attorney, Agent, or Firm*—J. D. Wolfe

[57] ABSTRACT

A contoured foam seat characterized by having a foamed seat and back member with grooved-out portions to give a raised area whereby the seat has contoured body fitting aspects.

6 Claims, 3 Drawing Figures

CONTOURED FOAM SEAT

This invention relates to an improved seat or chair for supporting a body in essentially an upright position. More particularly, this invention relates to a body support device having conventional appearing foamed members, said foamed members being capable of exerting a limited body-restraining effect.

Foamed chairs, seats and related body support devices have been made for years, but difficulty has been experienced in getting a foam sufficiently firm to support the body without the body support device exhibiting the property of being harsh and feeling like a board. Also, a person riding in a car tends to be forced about on the seat due to centrifugal forces. Consequently, it has been the practice for a number of years to put so-called "bucket" seats in sport cars. Bucket seats have a number of drawbacks, for instance, a car with two bucket seats in the front is essentially limited to two people, whereas the conventional full bench seat can handle three people. A further difficulty with bucket seats is they do not fit a real large or a very small person.

An object of this invention is to provide seating having the conventional appearance but capable of exerting significant body restraint.

The objects and advantages of this invention more readily can be seen and appreciated and understood by reference to the drawings, wherein FIG. 1 is a upright cross-section through a full bench type seat showing the features giving the seat a body fitting contour under load;

Figure 1:
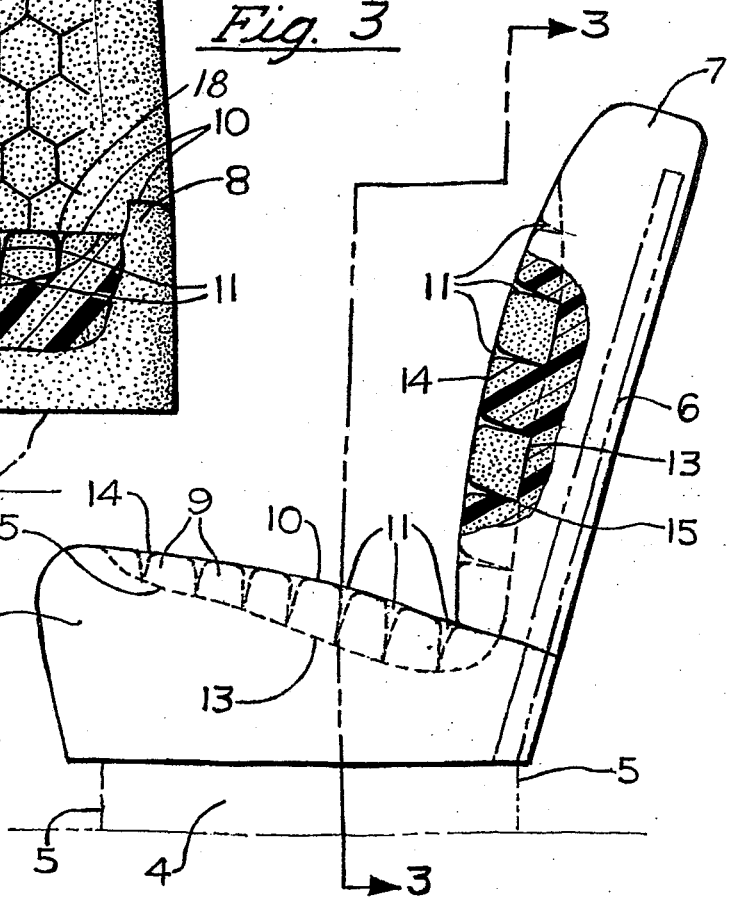

Referring more specifically to FIG. 1, number 4 designates a seat support having legs 5 and a back member 6 projecting upward to receive the foamed seat back 7. The foamed seat cushion 8 rests upon the seat support 4.

The bench type seat of FIG. 1 is shown with the foam cushion member 8 formed as a unit and the back member formed as a unit. Alternately, the foamed seat and back members can be molded as an integral unit instead of as two or more units. Actually the shape of the seat can be any of the conventional types such as bench or bucket as the form fitting feature of this invention can be built in any of the well-known seat types.

Figure 2:
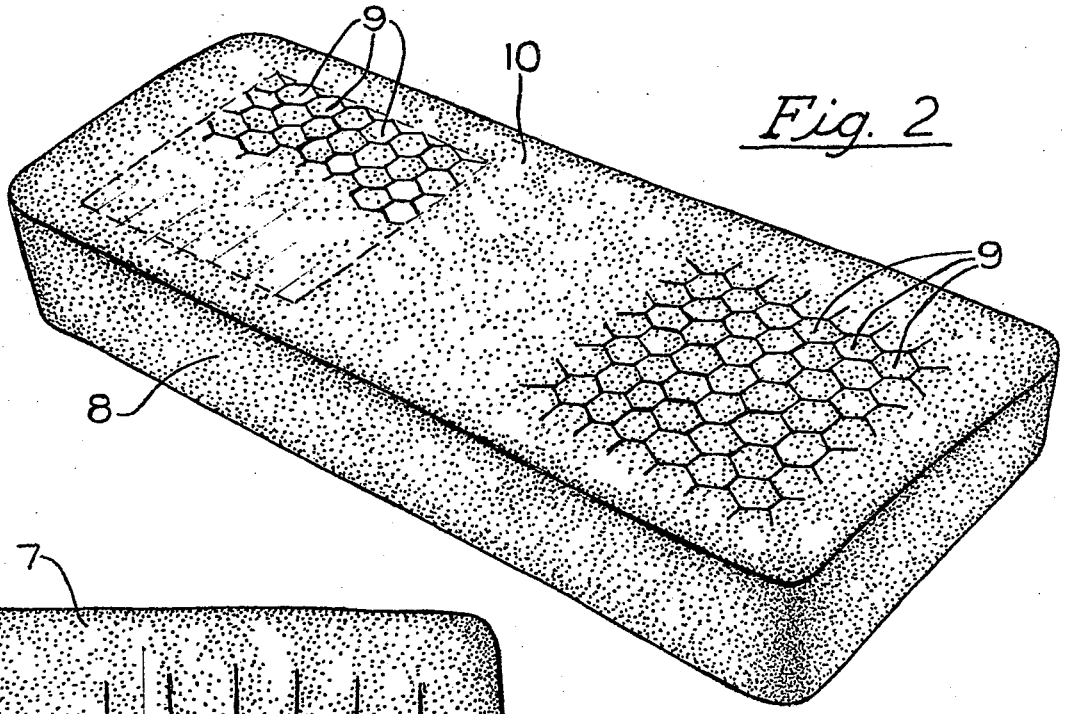
FIG. 2 is a perspective view of the bench seat cushion of FIG. 1.

For example, the conventional foamed bench seat of FIG. 2 is molded with grooved-out areas in the upper surface thereof. These grooved-out areas can be of any well-known geometric configuration. For instance, the foamed bench seat of FIG. 2 was molded with a series of hexagonal shape raised areas 9 or in a hexagonal pattern in the upper surface 10 of the bench seat. The raised areas 9 are surrounded by a series of interconnecting grooves.

Figure 3:
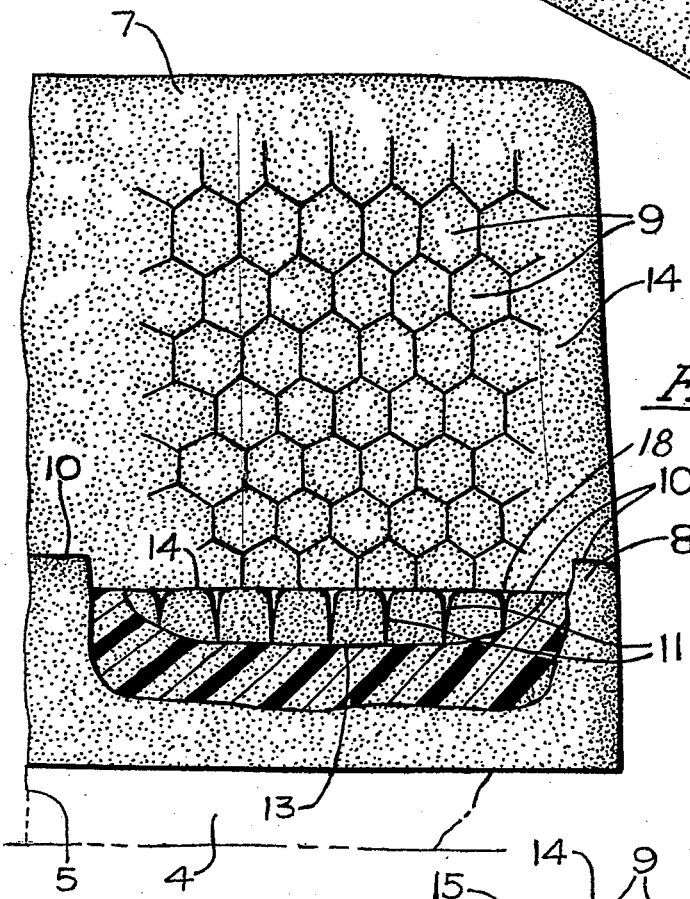
FIG. 3 is a cross-sectional view through FIG. 2 along line 2—2.

Preferably the grooves have a tapered or V-shape 11, as seen best in FIGS. 1 and 3. For instance, the groove width varies from the top surface of the seat member, preferably from 5/16 to 9/16 inch at the top of the groove to 1/16 to ¼ inch at the bottom of the groove. Any groove pattern is acceptable so long as they interconnect, but it is preferable that they run in short lengths and change direction giving a zig-zag pattern such as with a hexagonal configuration and the noncored or raised areas can be deflected initially as independent units.

The resulting noncored out portion or raised areas can yield readily to loading to give a soft feel initially and as they are deflected can progressively resist compression to give a foam member having the ability to fit the body contour and giving a very pleasing feeling and yet the cover has a smooth appearance in the unloaded state.

As the number of sides to the raised portions increases, it becomes a circle and in some aspects a nested circular pattern resists the cover on each member tucking into the cored-out grooves, as well as the hexagonal pattern. Preferably the depth of the grooves vary from the front 14 to the back 15 of the seat cushion or back members as best seen in FIGS. 1 and 3. By controlling the depth of the grooves it is possible to determine the area of sink of a body of a given weight in the foam and thereby control the sink or depressed area. Initially the grooves at the front and back of the seat cusion or the back members may be as shallow as a quarter of an inch, as shown by numerals 14 and 18 and increase in depth to near midpoint of member 13.

The depth of the grooves can vary as desired to conform to the shape of the occupant but must bear a relationship to the area of the raised portion such that it acts as a compression block and is not subject to buckling or column effect. Preferably the raised or noncored portion is 1½ inch to 5 inches across with groove depth ranging from ¼ inch to 2½ inch.

Heretofore we have disclosed our invention in aspects of depth varying from front to back of the seating or backing member but this depth variation can be used to advantage longitudinally of the front and back member with depth variation being essentially as disclosed above. In one of the preferred embodiments the depth variation of the grooves is limited longitudinally and transversely to correspond essentially to the area occupied by two or more people sitting on a conventional bench type seat. For instance, see FIG. 2 where two areas are cored out, with an area in between that is not cored out. It should be understood that if the seat is of the conventional bench seat type having a polyurethane foamed cushion member and a polyurethane foamed back member, it is preferred to have three cored-out body contacting areas in the seat cushion and back members.

EXAMPLE

A seat member mold of rectangular shape fitted with raised members or gates to give a hexagonal cored-out or grooved effect in the surface area was used to cast a seat member. The seat member was poured by pouring heads that give a fan-shaped pour pattern. Preferably one or more pouring heads are utilized as necessary dependent on the size of the article that can pour a fan-shaped pattern. The pouring head preferably is of the type described in U.S. Pat. No. 3,927,162. The pouring head pours a fan-shaped pattern that yields a crown-shaped bench type seat or back member having the desired hexagonal grooved pattern with no air entrapment or large bubbles obtained with other pouring heads.

Once the polyurethane foamable reaction mixture of polyether polyol or polyester polyol and an organic polyisocyanate and sufficient water and/or auxillary blowing agent, viz. fluorohydrocarbon to give a foam preferably of 2.5 to 3.5 density is poured into the mold, it is closed with a suitable lid. The foamable reaction mixture is allowed to foam and cure before the seat member is stripped from the mold. The seat member has a geometric pattern of grooves or cored-out areas having lengths preferably no more than about four inches before it terminates or changes directions. Thus, the noncored-out portion of the top area of the seat member can be compressed individually, preferably for at least 10 percent of its height before adjacent noncored-out areas begin to deflect.

This method of making a foam seat member permits it to be made with relatively high crowns or slopes in the manner of the conventional bench seats.

To recapitulate, this method of making the seat member comprises effecting relative movement between a pour means, preferably one or more pour heads, and a mold having a cavity with a configuration of seating member or back member in the bottom thereof. This curvature of the cavity to achieve the desired configuration of seat members, viz. the seat and back is divided by suitable gates or raised portions to give a cored-out pattern in the crown of the molded product, for instance, a series of truncated pyramids or hexagonal members. The polyurethane seating or cushion type foam reaction mixture is distributed in a fan-shaped arc in response to the relative movement between the pouring means and the mold to distribute the mixture from one end and over the gates to the other end of the mold. This relative movement may be achieved by manually moving the mold or the pouring means relative to each other or by apparatus such as described in U.S. Pat No. 3,247,295 of J. E. Burwell. After the foamable liquid polyurethane reaction mixture of the seating or cushion grade is distributed over the mold the mold is closed and the mixture allowed to foam to fill the mold and to cure within the mold before removing the molded core from the mold.

While certain representative embodiments and details have been shown for the purpose of illustrating the invention, it will be apparent to those skilled in this art that various changes and modifications may be made therein without departing from the spirit or scope of the invention.

What is claimed is:

1. In an improved seat including a support means for a foamed body contact member, the improvement wherein the surface of the foamed body contact member has cored-out areas, said cored-out areas being positioned to give a geometric pattern of grooves that extend continuously in lengths no more than four inches before the grooves terminate or change direction to give raised portions, each portion being capable of being compressed independent of any other portion for at least 10 percent of its compression deflection.

2. The improved seat of claim 1 wherein the geometric pattern is hexagonal.

3. The improved seat of claim 1 wherein the geometric pattern extends across the foamed body contact member on a bias to each edge.

4. The improved seat of claim 1 wherein the cored-out areas are essentially coextensive with the area covered by a body resting on the seat in the normal position.

5. The improved seat of claim 1 wherein the depth of the cored-out area varies from the outer edge of the cored-out area to essentially midpoint in at least one direction of the foam member.

6. The improved seat of claim 5 wherein depth of the cored-out area varies in both longitudinal and transverse directions.

* * * * *